United States Patent [19]

Hirt

[11] Patent Number: 4,462,356

[45] Date of Patent: Jul. 31, 1984

[54] MAGNETO POWERED IGNITION SYSTEM WITH IGNITION-OPERATED SPEED LIMITING

[75] Inventor: Adam Hirt, Ammerndorf, Fed. Rep. of Germany

[73] Assignee: Robert Bosch GmbH, Stuttgart, Fed. Rep. of Germany

[21] Appl. No.: 417,352

[22] Filed: Sep. 13, 1982

[30] Foreign Application Priority Data

Sep. 22, 1981 [DE] Fed. Rep. of Germany ..... 3137550

[51] Int. Cl.[3] ..... F02P 9/00

[52] U.S. Cl. ..... 123/335; 123/149 C; 123/149 D

[58] Field of Search ..... 123/335, 630, 149 D, 123/149 C, 149 A, 149 R, 198 DC

[56] References Cited

U.S. PATENT DOCUMENTS 3,884,203 5/1975 Cliffgard ..... 123/335
3,993,031 11/1976 Schmaldienst et al. ..... 123/335
4,186,711 2/1980 Jöerg ..... 123/630
4,211,195 7/1980 Zechlin ..... 123/335
4,329,950 5/1982 Orova et al. ..... 123/149 D
4,344,395 8/1982 Kondo et al. ..... 123/335

FOREIGN PATENT DOCUMENTS 2751213 5/1979 Fed. Rep. of Germany .

*Primary Examiner*—Andrew M. Dolinar
*Attorney, Agent, or Firm*—Frishauf, Holtz, Goodman & Woodward

[57] ABSTRACT

Voltage halfwaves generated by a magneto in one polarity are utilized for powering and timing ignition of an internal combustion engine, and voltage halfwaves of the opposite polarity, taken from the circuit of the primary winding, are utilized both to feed a regulated d.c. voltage source for a timing circuit and to provide a recurring trigger voltage for a monostable circuit that keeps the ignition control circuit operative only so long as the speed of the engine does not exceed a predetermined limit. The monostable circuit is constituted by appropriate connecting up of an available timer integrated circuit unit.

14 Claims, 5 Drawing Figures

MAGNETO POWERED IGNITION SYSTEM WITH IGNITION-OPERATED SPEED LIMITING

This invention concerns an ignition system for an internal combustion engine of the kind powered by a magneto generator that does not require the interposition of a storage battery in the system and incorporates engine speed limiting by intermittent suppression of ignition.

A known system of this type is disclosed in German patent publication DE-OS 27 51 213 in which two monostable multivibrator circuits, commonly referred for short as "monoflops", connected one behind the other, are utilized for engine speed limiting. The output of the last monoflop is connected, along with the output of an electronic control apparatus for ignition timing, to the control input of an interruptor switch through an AND-gate. When the maximum permissible engine speed is overstepped, the AND condition of the gate is no longer satisfied and ignition is thereby suppressed. For repetitively turning on the monoflops and triggering the control apparatus, a separate control transducer is provided that is driven by the engine, and a voltage supply separate therefrom is necessary for energizing the ignition system.

The system just described has the disadvantage that in the case of a magneto ignition system a supplemental control transducer is required in addition to the magneto generator supplying the supply voltage, because the trigger pulses for the monoflops must be produced at regular intervals dependent upon the engine speed. The generator voltage in the primary circuit of the magneto ignition system cannot be utilized for this purpose. A separate control transducer is expensive, however, and in the case of relatively small magneto ignition systems, it is also undesirable for reasons of bulk and can be feasibly added only with substantial expense and complication. It is disclosed in the present Assignee's copending U.S. patent application Ser. No. 265,592 now U.S. Pat. No. 4,329,950. to provide control of magneto ignition systems without a separate control transducer by directly connecting a control circuit to the primary winding circuit of the ignition system. In this case, the ignition current halfwave in the primary winding circuit is used for ignition timing. The speed control circuit of the previously mentioned publication cannot be used in this case, however, because the primary winding current halfwave has a relatively small voltage amplitude before the instant of ignition and therefore the two monoflops cannot be reliably or precisely triggered. The higher primary winding voltage produced at the instant of ignition is likewise unsuitable for controlling the monoflops, since when the engine speed is being held at its maximum by suppression of ignition this higher voltage no longer appears.

SUMMARY OF THE INVENTION

It is an object of the present invention to provide a magneto powered ignition system with engine speed control by intermittent ignition suppression which is reliably operable without the necessity of providing a control transducer separate from the magneto generator that powers the ignition system.

Briefly, both the signal voltage for triggering a monoflop and the electrical energy supply for the control circuit of the interruptor switch in the ignition primary winding circuit are supplied with energy from a magneto generator winding that serves for control and energization of the ignition system, the above-described disadvantages being avoided by applying voltage halfwaves of the ignition primary circuit which are of a polarity opposite to that of voltage halfwaves therein used for ignition power and timing to the input of the monostable circuit. A particularly convenient embodiment of the invention is provided when the monostable relaxation circuit (multivibrator, monoflop) is incorporated in a very economical integrated circuit component available commercially, for example under the designation "timer 0555" made by Siemens AG in Germany. In this case, the trigger input of the integrated circuit unit is connected so as to respond to the ignition coil primary voltage, preferably through a voltage divider, and especially advantageously when that voltage divider, includes a capacitor. The preferred form of voltage divider for this purpose includes a capacitor interposed between resistance, in series combination connected across the primary winding of the magneto generator, with the trigger input of the integated circuit connected on the side of the capacitor which is connected through resistance to ground, while the other side of the capacitor is connected to the reset input of the integrated circuit. Preferably, the d.c. supply circuit for the integrated circuit is regulated through a Zener diode and from this stabilized d.c. voltage and RC time delay circuit is provided leading to the threshold voltage in put and the discharge input of the timer integrated circuit, which are connected together. The output of the integrated circuit, of course, leads to the ignition control circuit, preferably through a control transistor, followed by a controlled thyristor and a resistance capacitance network to a final control transistor which is arranged to short-circuit the control path of a Darlington switch for interrupting the circuit of the current in the ignition primary winding at the moment of ignition.

BRIEF DESCRIPTION OF THE DRAWINGS

Further details and optional features of the invention are described after a brief statement set forth below outlining the content of the drawings.

The chief advantage of the ignition system of the invention is that the speed-limiting monoflop can be triggered independently from the control circuit of the magneto ignition system by the voltage in the circuit of the primary coil of the magneto generator. There is also the further advantage that a second monoflop is no longer necessary and that intervals of the unstable condition of the monoflop become practical with the system of the invention. These intervals are the timing intervals characteristic of the monoflop and may be called its "dwell" intervals.

Figure 1:
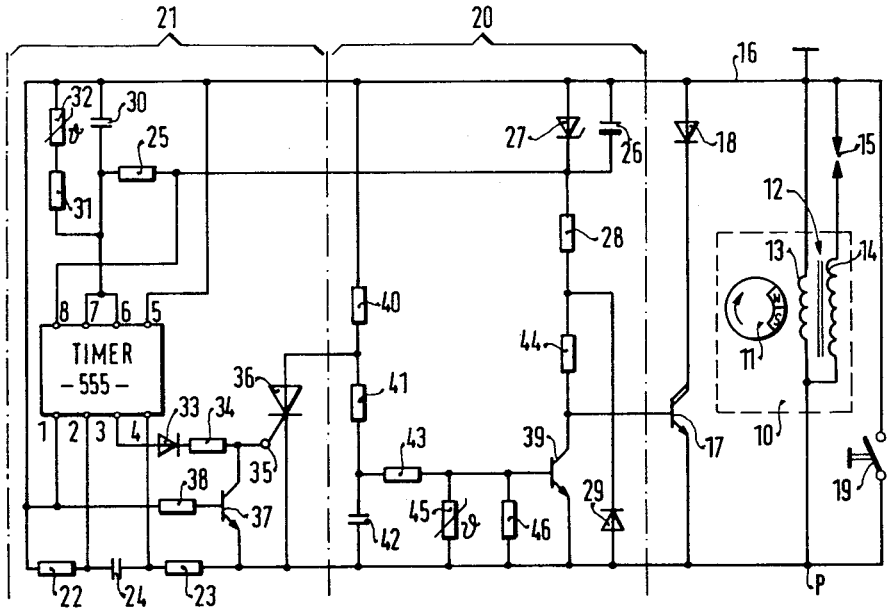
Figure 2:
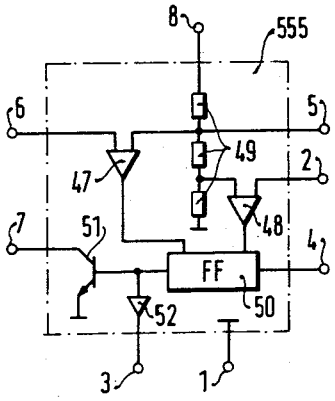

The invention is further described by way of illustrative example with reference to the annexed drawings, in which:

FIG. 1 is a circuit diagram of an ignition system according to the invention;

FIG. 2 is a circuit diagram, partly in block form, of the circuit block designated "timer" in FIG. 1 constituting the major part of the monostable multivibrator stage of FIG. 1.

Figure 4:
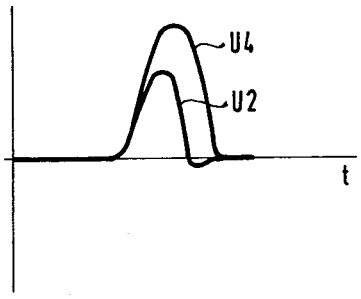
Figure 3:
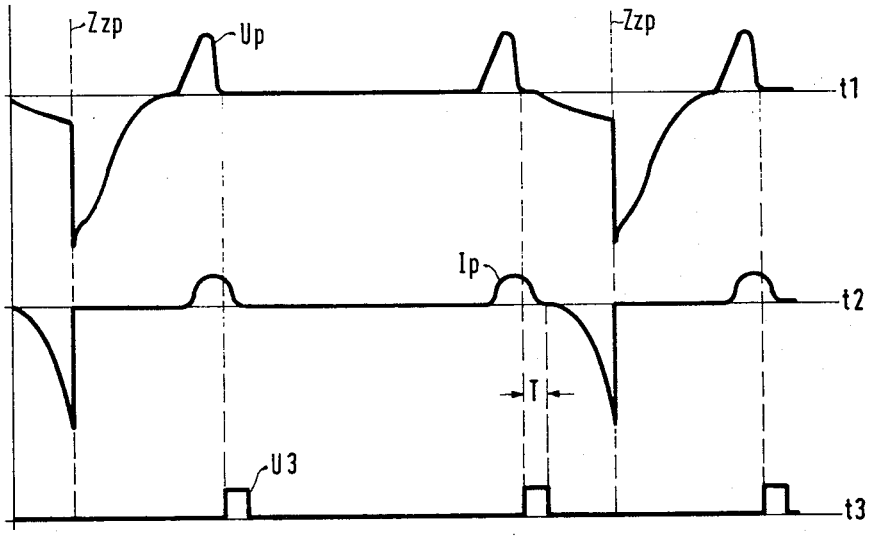
Figure 5:
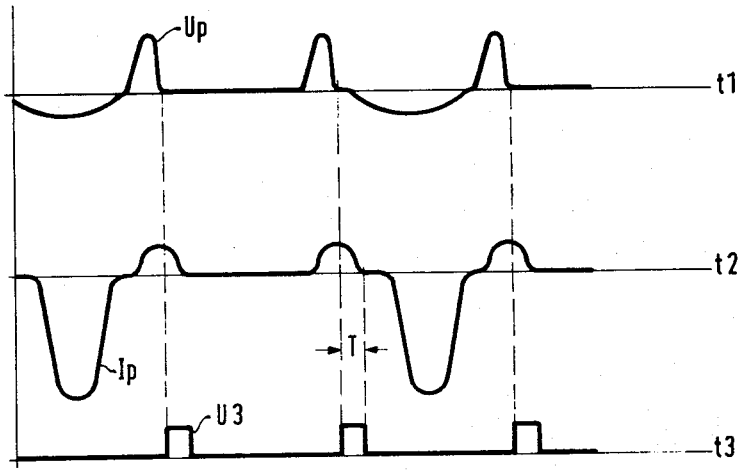

FIG. 3 is a diagram showing the course of voltage and current at various points in the circuit of FIG. 1 on a common time scale during operation in the range of permissible speed;

FIG. 4 is a graph showing the course of voltage at the inputs 2 and 4 of the timer circuit unit of FIG. 1 during a voltage halfwave in the primary winding circuit, and FIG. 5 is a graph showing the course of voltage and current when the limiting engine speed is overstepped, for comparison with FIG. 3.

DESCRIPTION OF THE ILLUSTRATED EMBODIMENT

The engine ignition circuit shown in FIG. 1 comprises a magneto generator 10 for energizing the ignition system, having a rotating pole wheel 11 driven by the engine. The pole wheel 11 cooperates with an ignition armature having an iron core 12, a primary winding 3 and a secondary winding 14, these windings constituting both generator armature windings and ignition coil windings at the same time. The secondary winding 14 has its high-voltage terminal connected to a sparkplug 15. The primary winding 13 is grounded at one end and connected in a primary circuit 16, in which an ignition transistor switch 17 in the form of a Darlington switching stage is connected so as to be capable of interrupting the current of the primary winding 13. For protection against reverse operation, the switching path of the ignition transistor 17 is connected in series with a diode 18. The primary winding 13 is also bridged with a stop switch 19 for stopping the engine. A control circuit 20 and also a speed-limiting circuit 21 are also connected to the primary winding 13, these two circuits being provided, along with the ignition transistor 17 and the diode 18, in a single casing which is not shown in the drawing.

The speed-limiting circuit 21 comprises a monostable relaxation stage which has an operating characteristic equivalent to that of a monostable multivibrator, being in in this case constituted in large part by an integrated circuit unit of the kind commonly designated as a 0555 timer, identified with the reference numeral 555 in the drawing. This integrated circuit unit, hereafter referred to as the timer, has its terminals, numbered 1 to 8, externally connected as shown in FIG. 1. The timer 555 is arranged to be triggered by the voltage in the primary winding circuit through its trigger input 2, by virtue of a connection to a tap of a voltage divider that is provided in the primary winding circuit. The voltage divider consists of two resistances 22 and 23, connected in series, between which a capacitor 24 is inserted. The trigger input 2 is connected to that side of the capacitor 24 which is connected over the resistor 22 to the grounded winding end of the magneto generator 10. The reset input 4 of the timer 555 is connected to the other side of the capacitor 24, from which the resistance 23 leads to the other end of the primary winding of the magento generator 10.

A threshold voltage input 6 of the input 555 is connected, in common with the discharging input 7 of the timer, to the tap of a series RC network 25, 30, the capacitor end of which is grounded, and the resistor end of which is connected to a stabilized d.c. voltage source. The latter is constituted by a storage capacitor 26 having a Zener diode 27 in parallel thereto, this parallel combination being connected on one hand to ground and on the other through a resistance 28 and a diode 29 to the ungrounded end of the primary winding of the magneto generator 10. The diode 29 is so poled that it is in its blocking condition for the voltage halfwaves in the primary winding circuit 16 which are used for ignition. A voltage supply terminal 8 of the timer 555 is also connected to the storage capacitor 26 of the stabilized d.c. voltage source. The control voltage input 5 of the timer 555 is connected to ground in order to obtain very short dwell intervals in the operation of the monostable circuit. In order to obtain a dwell interval magnitude that is independent of temperature, the capacitor 30 of the RC network 25,30 is bridged by a fixed resistor 31 and a temperature-dependent resistor 32.

The timer unit 555, together with the connections shown and described above, forms a monostable circuit that has the trigger terminal 2 as its input and the output terminal 3 of the timer 555 as its output. The output terminal 3 is connected through a diode 33 and a resistance 34 to the gate 35 of a control thyristor 36. The control thyristor 36 can also be called a semiconductor controlled rectifier or SCR, but the term "thyristor" is used because it reads more easily.

The control thyristor 36 is connected so as to bridge a part of the control circuit 20 for the ignition transistor 17. The switching path of a transistor 37, of which the base electrode is connected through a resistor 38 to ground, is provided in parallel to the control path of the control transistor 36.

The control circuit 20 contains a control transistor 39 having a switching path connected in parallel to the control path of the ignition transistor 17. The base-emitter path of the control transistor 39 is connected to a timing network associated with the primary winding circuit. The timing network consists of a series connection of the resistances 40 and 41 with a capacitor 42, with the resistance 40 connected to ground and the capacitor 42 connected through a further resistance 43 in parallel to the base-emitter path of the control transistor 39. The capacitor 42 and the resistance 41 provided in series therewith are bridged and can be short-circuited by the control thyristor 36 of the speed-limiting circuit 21. For switching on the ignition transistor 17, the base of the latter is connected through a resistance 44, a resistance 28 and the Zener diode 27 to the terminal of the primary winding 13 that is grounded. Temperature compensation of the instant of ignition is obtained by means of a temperature-dependent resistance 45 which, along with a trimming resistor 46, is connected in parallel to the control path of the control transistor 39.

The circuit of the timer 555 of FIG. 1, as shown in FIG. 2, contains two comparators 47 and 48, each having an input connected to a separate tap of the voltage divider 49. The other input of the comparator 47 provides the threshold voltage input 6 and the corresponding input of the comparator 48 provides the trigger input 2. A flipflop (multivibrator) 50 is switched over by the respective outputs of the two comparators 47 and 48. The output of the flipflop on the one hand switches the discharge input 7 to ground through a transistor 51 and, on the other hand, switches the condition of the output terminal 3 through an output stage 52. The flipflop 50 is reset by the reset input 4 and the switching interval is controllable by the control voltage input 5, which is grounded for minimum timing interval. The voltage supply terminal 8 is connected to the stabilized d.c. voltage and, of course, the ground terminal 1 is connected to ground.

Operation

The ignition system of FIG. 1 operates in a manner usefully illustrated in the graphs of FIGS. 3, 4 and 5. It may at first be assumed that the internal combustion engine, which is not shown in the drawing, is operating in the permitted speed range. In this case, the course of the primary voltage Up generated in the primary winding 13 by the revolving pole wheel is shown as plotted in FIG. 3 against the time axis t1. The voltage at the end of the primary winding 13 that is not connected to ground is measured at the point P of the circuit of FIG. 1. With each whole revolution of the pole wheel 11 a current flows at the beginning of a negative voltage halfwave Up in the primary circuit 16 over the Zener diode 27, over the resistances 28 and 44, to the base of the ignition transistor 17, and switches the latter into the conducting condition. A primary current Ip then begins to flow, as shown on the time axis t2. At the same time, the primary voltage Up charges the capacitor 42 over the resistances 40 and 41 of the control circuit 20. At the ignition instant, the charge of the capacitor 42 reaches a value at which the control transistor 39 is switched over into the conducting condition. The control circuit of the ignition transistor 17 is shunted thereby, and the primary current Ip is immediately blocked by the ignition transistor 17. A high voltage pulse is thereby produced in the secondary winding 14 which causes the striking of a spark in the sparkplug 15.

After the subsidence of the negative voltage halfwave in the primary circuit 16, the pole wheel 11, with its poles moving away from the ignition armature, still provides a smaller positive voltage halfwave, which is in the blocking direction for the ignition transistor 17. This positive voltage halfwave of the primary voltage Up charges the capacitor 26 through the diode 29 and the resistor 28 until the Zener voltage of the Zener diode 27 is reached, for example 12 volts. At the same time, the capacitor 30 of the RC network in the speed-limiting circuit 21 is charged.

The terminal 8 of the timer 555 is thereby also put at the supply voltage thus provided. This positive voltage halfwave also reaches the voltage divider composed of the resistances 22 and 23 and the capacitor 24, and connected to the trigger input 2 and the reset input 4 of the timer 555. It can be seen from the voltage course shown in FIG. 4 that the voltage U2 at the trigger input 2 of the timer 555 lags behind the voltage U4 at the reset input 4 by the charging-up of the capacitor 24. As soon as the voltage U2 goes back to zero, the flipflop 50 in the timer 555 is set by the comparator 48, and a switching pulse U3 shown on the time axis t3 of FIG. 3 appears at the output terminal 3, whereby the control thyristor 36 is fired. At the same time, the capacitor 30 of the RC network is discharged through the discharging input 7 of the timer 555. With suitable dimensioning of the circuit electrically, the capacitor 30 is discharged to such an extent after a time period T of 170 μs, that the capacitor voltage applied to the threshold voltage input 6 switches over the comparator 47. The flipflop 50 is now reset and the switching pulse is ended. The capacitor 30 of the RC network immediately beings to charge up again under the stabilized d.c. voltage of the storage capacitor 26.

With further revolution of the pole wheel 11, a positive voltage halfwave Up is generated anew in the primary current 16 shortly before the following negative ignition halfwave. At the timer 555, there accordingly appears again a switching pulse U3 with a pulse width T of 170 μs. In the permissible engine speed region, the control thyristor 36 is again blocked without interruption of its extinguished condition, because at this instant there is still no current flowing in the conduction direction of the control thyristor 36.

When the permissible limiting engine speed of, for example, 9000 r.p.m. is overstepped, the control thyristor 36 is released by the switching pulse U3 at the output terminal 3 of the timer so close to the beginning of the primary current halfwave used for ignition that the control thyristor 36 cannot be re-blocked soon enough to prevent conduction. It can be seen from FIG. 5 that towards the end of the control pulse U3 the primary current Ip already begins to flow. Along with the main current which flows in the ignition transistor 17, there also flows a control current over the resistor 40 and the control thyristor 36. The capacitor 42 is therefore no longer charged up, and it can no longer switch over the control transistor 39 into the conducting condition at the ignition instant. The control voltage necessary therefor is suppressed by the conducting control thyristor 36. That has the consequence that the ignition transistor 17 can no longer be blocked at the ignition instant and in consequence no ignition spark can be produced at the sparkplug 15.

In order to assure that the ignition system will not malfunction in the idling speed region by switching pulses of the timer 555 which could possibly be produced by an insufficient voltage supply, the capacitor 24 in the voltage divider 22,23 has one terminal connected to the trigger terminal 2 and its other terminal connected to the reset terminal 4 of the timer 555. The voltage shift between the two inputs thus produced is recognizable in FIG. 4. This shift has the effect that the timer 555 is first triggered by the null transition of the voltage U2, while thereafter by the null transition of the voltage U4, the flipflop 50 of the timer 555 and thereby necessarily its output 3, are reset to their original condition. This compelled resetting takes place also in the lower speed region of the engine to the extent that the pulse duration T of the monostable circuit has not yet run its course.

By means of the transistor 37 connected across the control path of the control thyristor 36, it is furthermore provided that the thyristor 36 will not be fired during a negative halfwave of the primary voltage Up by disturbing voltages at the timer 555. The transistor 37 is put into its conducting condition when a negative voltage halfwave appears in the primary circuit 16, so that the transistor 37 shunts out any such disturbing pulses that may appear.

The speed-limiting ignition circuit according to the invention is of course not limited to the illustrated embodiment. It is equally applicable to magneto ignition systems with a multiplicity of magnet poles and to magneto ignition systems utilizing an external ignition coil, as well as magneto ignition systems of the capacitor discharge ignition type. The current limiting circuit 21 is in all cases so connected to the primary or voltage supply circuit of the ignition system that the monostable circuit is triggered only by the voltage halfwaves which are of a polarity opposite to the voltage halfwaves necessary for ignition.

It will also be observed with reference to the description of FIG. 2 that a monostable multivibrator circuit can be constituted not only by a multivibrator of the more conventional monostable type, but also by a flipflop or bistable multivibrator arranged in circuit for automatic resetting after a predetermined interval. Both types of circuits can be referred to generically as monostable multivibrator stages or, more briefly, as monoflops.

I claim:

1. Magneto powered ignition system for an internal combustion engine incorporating engine-speed limiting of the intermittent ignition-suppression type, said system comprising primary and secondary ignition windings, a contactless electrically controlled switch means with a control circuit responsive to ignition timing signals in circuit with said primary winding, means including an engine driven magneto generator for providing power to said ignition windings and engine-driven ignition timing signal generator means, a monostable multivibrator stage for enabling operation of the ignition system so long as the engine speed does not exceed a predetermined limit by providing an input to the control circuit of said switch means, and further comprising the combination of:

means, including a magneto generator winding (13) serving in circuit as said primary ignition winding and also as a winding of said engine driven generator means for ignition energization from generated current and for providing both the signal voltage (Up) for triggering said monostable multivibrator stage and the electrical energy supply for the control circuit (20) of said switch means (17), and means for applying, to the input of said monostable multivibrator, voltage half-waves of said generator winding (13) circuit (16) which are of a polarity opposite to that of voltage half-waves in said generator winding (13) circuit (16) utilized for ignition power and timing.

2. Ignition system according to claim 1 in which said magneto generator winding (13) is provided on an ignition armature of said generator and a second winding is provided on said ignition armature for function as said secondary ignition winding, said magneto generator winding 13 circuit (16) being connected for supply of voltage therefrom for ignition timing in said control circuit of said switch means.

3. Ignition system according to claim 1, in which said monostable multivibrator stage is constituted at least in part by a timer circuit constituted as an integrated circuit unit having a trigger input (2) and by the voltage (Up) in said primary winding circuit (16) through said trigger input (2).

4. Ignition system according to claim 3, in which a voltage divider (22,23,24) is provided for connection of said trigger input (2) of said integrated circuit unit to said primary winding circuit (16).

5. Ignition system according to claim 4, in which said voltage divider consists of two resistances (22,23) connected in series with a capacitance (24) interposed between them.

6. Ignition system according to claim 5, in which said trigger input of said integrated circuit is connected on the side of said capacitance (24) of said voltage divider, which is connected through one of said resistances to the grounded end of said magneto generator winding (13), and in which the reset input of said integrated circuit unit is connected to the other side of said capacitance (24).

7. Ignition system according to claim 3, in which said integrated circuit unit has a threshold voltage input (6) and a discharging input (7) and an RC series circuit (25,30) is provided connected to a stabilized d.c. supply, said threshold voltage and discharging inputs both being connected to an intermediate point of said series RC circuit (25,30).

8. Ignition system as defined in claim 7, in which said stabilized d.c. voltage source comprises a storage capacitor (26) and a Zener diode (27) connected in parallel thereto, both of which are connected between the ground side of the circuit and a series combination of a resistance (28) and a diode (29) to the end of said magneto generator winding (13) which is not grounded, said last-mentioned diode (29) being poled so as to block the voltage halfwaves of said generator winding which are necessary for producing ignition.

9. Ignition system according to claim 8, in which said series RC circuit and a d.c. supply input (8) of said integrated circuit component are both connected, at a common connection, to said storage capacitor (26) of said stabilized d.c. voltage source.

10. Ignition system according to claim 3, in which said integrated circuit component has a control voltage input (5) which is grounded for shortening the timing period of the monostable stage.

11. Ignition system according to claim 3, in which a control thyristor (36) having a gate electrode (35) is provided in the control circuit (20) of said switch means (17) so as to partly bridge a portion (41,42) of said control circuit (20), and in which said gate electrode (35) is connected to the output terminal (3) of said integrated circuit component.

12. Ignition system according to claim 11, in which said switch means (17) is constituted by a Darlington switching circuit having a control path connected so as to be bridgeable by a control transistor (39) provided in said control circuit (20) of said switch means (17), the base-emitter path of said control transistor (39) being connected to a timing network (40,41,42) provided in said primary winding circuit (16), at least part of said timing circuit (40,41,42) being bridged by said control thyristor (36).

13. Ignition system according to claim 12, in which said timing circuit comprises a plurality of resistors (40,41,43,45,46) and a capacitor (42), said capacitor being connected over one of said resistors (43) to provide a path in parallel to the base-emitter path of said control transistor (39) and being connected in series with another one of said resistors (41) to provide a path for bridging by said control thyristor (36).

14. Ignition system according to claim 11, in which another transistor (37) is provided in a manner bridging the control path of said control thyristor (36) and having its base connected through a resistance (38) to ground.

* * * * *